US010619273B2

(12) United States Patent
Zheng et al.

(10) Patent No.: US 10,619,273 B2
(45) Date of Patent: Apr. 14, 2020

(54) INTERCHANGEABLE KNITTING NEEDLES WITH SECURE CONNECTION

(71) Applicants: Liyun Zheng, Troy, MI (US); Aimee Zheng, Troy, MI (US)

(72) Inventors: Liyun Zheng, Troy, MI (US); Aimee Zheng, Troy, MI (US)

(73) Assignee: Westing Bridge LLC, Troy, MI (US)

( * ) Notice: Subject to any disclaimer, the term of this patent is extended or adjusted under 35 U.S.C. 154(b) by 4 days.

(21) Appl. No.: 15/923,505

(22) Filed: Mar. 16, 2018

(65) Prior Publication Data

US 2019/0284736 A1 Sep. 19, 2019

(51) Int. Cl.
*D04B 3/02* (2006.01)

(52) U.S. Cl.
CPC ..... *D04B 3/02* (2013.01)

(58) Field of Classification Search
CPC ..... D04B 3/02; D04B 3/00; D04B 33/00
USPC ..... 66/117, 118
See application file for complete search history.

(56) References Cited

U.S. PATENT DOCUMENTS 1,269,014 A * 6/1918 Stansbery ..... D04B 3/00 279/9.1
1,999,691 A * 4/1935 Graham ..... D04B 3/02 66/117
2,061,282 A * 11/1936 LeBoof et al. ..... D04B 17/04 66/117
2,183,791 A * 12/1939 Dunn ..... D04B 3/02 403/165
2,208,124 A * 7/1940 Dunn ..... D04B 3/02 66/117
2,633,720 A 4/1953 Robbins
3,097,474 A * 7/1963 Rohdenburg ..... D07B 1/185 223/102
3,280,595 A 10/1966 Linstead
(Continued)

FOREIGN PATENT DOCUMENTS

CN 202865519 U 4/2013

OTHER PUBLICATIONS

DyakCraft webpage from Internet Archive (https://web.archive.org/web/20160529000418/http://www.dyakcraft.com:80/store/p12/Heavy_Metal%E2%84%A2_Tips.html), dated May 28, 2016, 2 pages.
(Continued)

*Primary Examiner* — Danny Worrell
(74) *Attorney, Agent, or Firm* — Reising Ethington P.C.

(57) ABSTRACT

A needle member for use as a knitting needle and methods of making the same are disclosed. An example needle member may be formed of a metallic material and include a solid tip end and a connecting end opposite the tip end. The connecting end may have a threaded portion configured to be selectively secured to a flexible cable by rotating the needle member relative to the cable, and a solid body extending longitudinally from the solid tip end to the connecting end which defines a needle grip aperture. The needle grip aperture may be fixed within the solid body relative to the threaded portion of the connecting end. An interchangeable knitting needle set may be provided, which includes a plurality of needle members and different length cables for selectively connecting two of the needle members to create different knitting needles having different lengths or needle diameters.

20 Claims, 2 Drawing Sheets

(56) References Cited

U.S. PATENT DOCUMENTS

| | | | | | |
|---|---|---|---|---|---|
| 3,384,220 | A * | 5/1968 | Linstead | D04B 3/00 | 206/227 |
| 4,341,094 | A * | 7/1982 | Heide | D04B 3/02 | 163/2 |
| 4,494,387 | A * | 1/1985 | Phipps | D04B 3/02 | 66/117 |
| 4,553,410 | A * | 11/1985 | Okada | D04B 3/02 | 66/117 |
| 4,646,543 | A * | 3/1987 | Okada | D04B 3/02 | 66/117 |
| 4,680,947 | A * | 7/1987 | Phipps, Sr. | D04B 3/02 | 66/117 |
| 4,846,351 | A * | 7/1989 | Gardiner | D04B 3/00 | 206/574 |
| 6,668,597 | B2 | 12/2003 | Robinson | | |
| 7,117,693 | B1 * | 10/2006 | Nova | D04B 17/04 | 66/117 |
| 7,954,342 | B2 * | 6/2011 | Devagnanam | D04B 3/02 | 66/117 |
| 8,181,489 | B2 * | 5/2012 | Selter | D04B 3/00 | 279/9.1 |
| 8,210,003 | B2 | 7/2012 | Zheng | | |
| 8,464,559 | B2 * | 6/2013 | West | D04B 3/02 | 66/117 |
| 8,499,586 | B1 * | 8/2013 | Adam | D04B 3/00 | 206/227 |
| 9,181,641 | B1 * | 11/2015 | Moraca | D04B 3/02 | |
| 2012/0118021 | A1 | 5/2012 | Zheng | | |

OTHER PUBLICATIONS

Clara Parkes, "Knit Picks Options", Electronic Colloquium, dated Jun. 29, 2006, Knitter's Review (4 pages).

Clara Parkes, "ChiaoGoo Twist and Spin Interchangeable Needles", Electronic Colloquium, dated Nov. 28, 2012, Knitter's Review (4 pages).

International Search Report and Written Opinion for Application No. PCT/US19/22396 dated May 23, 2019 (15 pages).

* cited by examiner

INTERCHANGEABLE KNITTING NEEDLES WITH SECURE CONNECTION

BACKGROUND

A fixed circular knitting needle generally includes two needle members permanently joined by a flexible cable. An interchangeable knitting needle may include two needle members and a flexible cable joined by way of a detachable connection. An interchangeable knitting needle set may be provided with multiple needle members of different lengths or diameters, and multiple cables of different lengths, to suit user preferences. At smaller diameters, e.g., smaller than 2.00 millimeters in diameter, interchangeable needle members generally become more difficult to secure to the cable by hand. More specifically, needle members that are smaller in diameter or shorter in length are generally more difficult to grip and apply sufficient force to adequately secure the needle member to the needle connector of a flexible cable.

Accordingly, there is a need for an improved interchangeable knitting needle that addresses the above difficulties.

BRIEF DESCRIPTION OF THE DRAWINGS

Referring now to the drawings, exemplary illustrations are shown in detail. Although the drawings represent some examples, the drawings are not necessarily to scale and certain features may be exaggerated, removed, or partially sectioned to better illustrate and explain the present invention. Further, the exemplary illustrations set forth herein are not intended to be exhaustive or otherwise limit or restrict the claims to the precise forms and configurations shown in the drawings and disclosed in the following detailed description:

DETAILED DESCRIPTION

Figure 1:
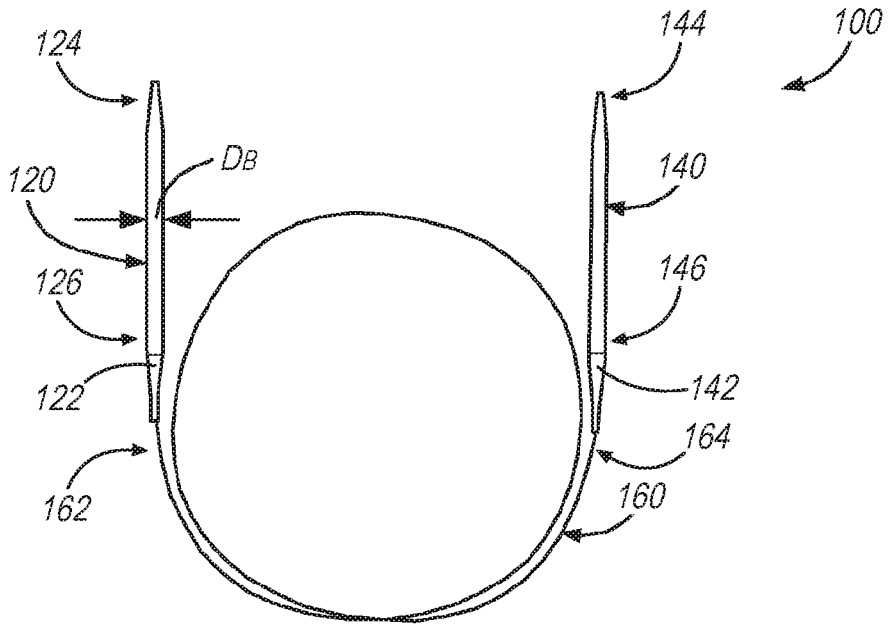
FIG. 1 is a top view of a circular knitting needle including two interchangeable needle members secured to a flexible cable by way of two needle connectors, according to one example.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms pray be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

In at least some examples, an interchangeable needle member may be formed of a metallic material and include a solid tip end and a connecting end opposite the tip end. The connecting end may have a threaded portion configured to be selectively secured to a flexible cable by rotating the needle member relative to the needle connector or cable, and a solid body extending longitudinally from the solid tip end to the connecting end. The solid body may generally define a substantially round lateral cross-section, as well as a needle grip aperture positioned adjacent the connecting end and extending laterally through the solid body. The needle grip aperture may be fixed within the solid body relative to the threaded portion of the connecting end. Moreover, the needle grip aperture may allow for enhanced grip of the needle member, increasing the degree to which the needle member may be tightened by hand.

In some example approaches, an interchangeable knitting needle set may include a plurality of needle members and different length cables for selectively connecting two of the needle members to create circular knitting needles having different overall lengths and/or diameters. For example, in one approach at least four interchangeable needle members are provided in a set, with one pair of the interchangeable needle members having a first needle length and a second pair of the interchangeable needle members having a second needle length greater than the first needle length. Continuing with this example, at least two interchangeable cables for selectively securing any two of the interchangeable needle members together are also included in the set. Each of the cables may have needle connectors at opposite ends thereof, at least a first one of the needle connectors of each of the cables defining a cable grip aperture and a connector thread configured to be secured to the threaded portion of one of the needle members. The two interchangeable cables may have different lengths.

As best seen in FIG. 1, a knitting needle assembly 100 may include first and second needle n embers 120, 140 connected by a cable 160. While the disclosure is generally directed to knitting needle assemblies, in other examples crochet hook assemblies may be employed. Therefore, while discussed in combination with first and second needle members, it is understood that the present disclosure applies equally to arrangements where the first and second needle members 120, 140 are in the form of crochet hooks. As shown in FIG. 1, the knitting needle 100 may be a circular knitting needle, i.e., where the flexible cable 160 may be wrapped in a circular or semi-circular fashion as shown. However, the concepts described herein are not solely limited to circular knitting needles. Merely as one example, a needle member substantially as described herein may be connected to a first end of a flexible cable, which is provided with an end stopper at an opposite end thereof.

The needle members 120, 140, in contrast to the flexible cable 160, may generally be relatively inflexible. In an example, the needle members 120, 140 are each formed of a metallic material, such as stainless steel. As shown in FIG. 1, the size of the needle member 120, 140 may be defined by a laterally extending diameter $D_B$ of the needle main body, as will be described further below. As will also be described further below, the needle members 120, 140 may have any longitudinal length that is convenient. Moreover, while the needle members 120, 140 are illustrated having the same diameter and length in FIG. 1, in some examples different diameters and/or length needle members may be employed with the cable 160.

The cable 160 may include a braided metal cable formed from metal strands, which strands are covered with a nylon coating. The braided metal cable and nylon coating (not shown) may be sized to accommodate flexibility and crimping, e.g., to a needle connector as will be discussed below. In one example, a braided metal cable as disclosed in U.S. Pat. No. 8,210,003 is employed.

The needle members 120, 140 may each have a tip end 124, 144, respectively, which may be generally pointed or otherwise configured to facilitate knitting. Connector ends 126, 146 may be disposed opposite the tip ends 124, 144 of each of the needle members 120, 140. The connector ends 126, 146 may be connected to the cable 160 via respective needle connectors 122, 142. As will be described further below, the needle connectors 122, 142 may each allow for selective securement/removal of the needle members 120, 140, e.g., by way of a threaded connection. More specifically, the needle connectors 122, 142 may each have female or male threads that correspond to those of the connector ends 126, 146 of the first and second needle members 120, 140. The needle connectors 122, 142 may each be secured to the flexible cable 160, e.g., by way of a crimped connection.

In one example, the needle connectors 122, 142 are secured to corresponding ends 162, 164 of the cable 160, respectively, using a crimped connection as that described in U.S. Pat. No. 8,210,003. Thus, the ends 162, 164 of the cable 160 (including the braided metal cable and the nylon coating thereof) may be located in a bore (not shown in FIG. 1) defined by the respective needle connectors 122, 142.

Any size or configuration of the cable 160 may be employed that is convenient. In one example, the cable 16 may include a braided metal cable formed from metal strands, with the strands collectively covered with a nylon coating. The braided metal cable and nylon coating may be sized to accommodate crimping to the needle connectors 122, 142 and a flexibility of the cable 160, as described in U.S. Pat. No. 8,210,003. In another example, for a needle diameter less than 4.0 millimeters (mm), the cable 160 includes an overall diameter of 1.0 mm to 1.6 mm. The cable 160 may be formed from a relatively large number of metal strands, e.g., 40 to 60 strands, with each of the strands having a diameter between 0.01 mm and 0.015 mm. In other examples, a greater number of strands may be used. Generally, larger numbers of strands may be used where the strands themselves are smaller in diameter, with the increase in number of strands (and smaller diameter of the individual strands) providing increased overall flexibility of the cable 160. The nylon coating may define a wall thickness of 0.2 mm to 0.3 mm, merely as one example.

Figure 2:
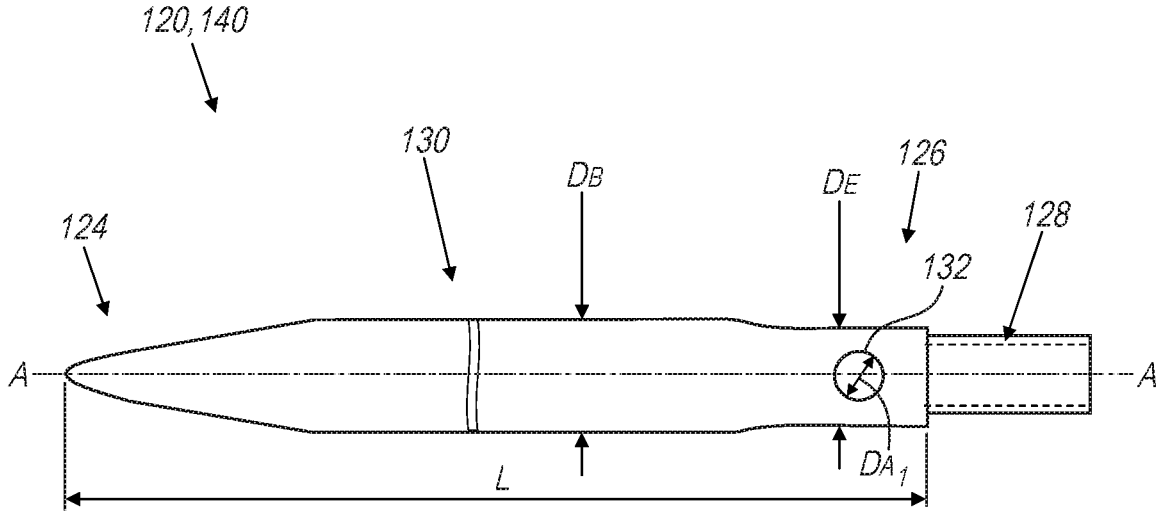
FIG. 2 is an enlarged view of one of the interchangeable needle members of FIG. 1, according to one example approach.
Figure 3:
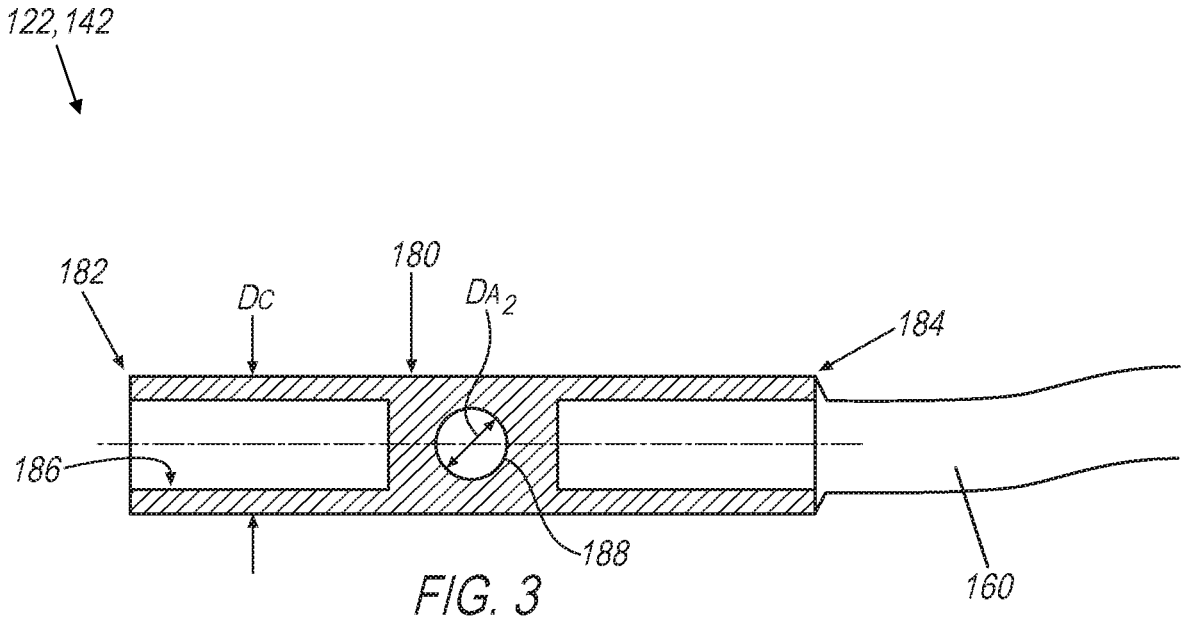
FIG. 3 is an enlarged view of one of the needle connectors of FIG. 1, according to an example.

Turning now to FIGS. 2 and 3, the needle members 120, 140 and needle connectors 122, 142 will be described in further detail. In some examples, the needle members 120, 140 may be identical, e.g., with respect to construction, configuration, and/or the manner in which they are selectively connected or removed from the needle connectors 122, 142. Therefore, for simplicity, the second needle member 140 and the needle connector 142 will not be described in detail with the understanding that the description of the first needle member 120 and needle connector 122 herein may apply equally. The needle members 120/140 may be of identical size, i.e., such that the diameter $D_B$ and length L (see FIG. 2) are equal. Alternatively, the needle members 120/140 may have different diameters $D_B$ and/or lengths L.

As best seen in FIG. 2, needle member 120 includes a generally solid tip end 124 opposite connector end 126. The connecting end 126 includes a threaded portion 128 fixed to the needle member 120 and configured to be selectively secured to corresponding threads (not shown in FIG. 2) of the needle connector 122. Any thread construction may be employed that is convenient. Merely as one example, the threaded portion 128 may define radially outwardly facing male threads configured to be secured to radially inwardly facing female threads of the needle connector 122 (not shown in FIG. 2) by relative rotation of the needle member 120 with respect to the needle connector 122, about a longitudinal axis A-A of the needle member 120.

The needle member 120 may generally comprise a solid body 130 extending longitudinally along the axis A-A of the needle member 120 from the solid tip end 124 to the connector end 126. The solid body 130 may be formed of a solid metallic material, and may define a substantially round lateral cross-section.

The solid body 130 may define a needle grip aperture 132 that is adjacent to the connecting end 126, and extending laterally through a portion of or entirely through the solid body 130. The needle grip aperture 132 may be fixed within the solid body 130 relative to the threaded portion 128 of the connecting end 126.

In one example, the solid body 130 is formed of a solid metallic material, e.g., by way of a turning process applied to a needle stock (not shown). The needle grip aperture 132 may be subsequently formed in the solid body 130, e.g., by drilling or any other convenient material removal process. The edges of the needle grip aperture 132 along the outer surface of the solid body 130 may generally be smooth or otherwise configured to facilitate yarn or other knitted material sliding along the solid body 130 and over the needle grip aperture 132.

The solid body 130 may define a maximum needle member diameter $D_B$ of the needle member 120. The connecting end 126 may define the needle grip aperture 132 and generally be configured to connect to a needle connector 122 of cable 160, as will be described further below. The connecting end 126 may define a diameter $D_E$, which may be smaller than or equal to the diameter $D_B$ of the needle member 120. The diameter $D_B$ of the outer surface of the solid body 130 may be any size that is convenient. The solid body portion 130 may define a cross-sectional diameter that varies longitudinally along the solid body portion 130, as shown in FIG. 2, while in other examples the outer diameter $D_B$ is equal (or substantially so) to the diameter $D_E$ of the connecting end. Moreover, as will be described below, in some interchangeable knitting needle sets, multiple needle members 120/140 may be provided having different configurations, e.g., different diameters, lengths, etc.

The needle grip aperture 132 may have a diameter $D_{A1}$, as illustrated in FIG. 2. While any size of the needle grip aperture 132 may be employed that is convenient, in an example the needle grip aperture 132 has a diameter $D_{A1}$ that is no greater than one half of the diameter $D_E$ of the connector end 126. In one example, the diameter $D_{A1}$ of the needle grip aperture 132 is 0.75 mm, while the diameter $D_E$ of the connector end 126 is 1.5 mm.

As noted above, the needle member 120, including the tip end 124, solid body 130, and connector end 126, may be formed of a metallic material such as stainless steel. In an example, the needle member 120 is formed from a round stock, e.g., in a turning process, to form the general shape of the tip end 124 and the solid body 130. The connector end 126 may be formed in a material removal process such as turning, merely as one example, to provide the generally reduced diameter size of the connector end 126 (and, as seen in FIG. 2, the further reduced diameter of the threaded portion 128). In this manner, the needle member 120 may be generally formed as a solid monolithic piece. In other examples, the connector end 126 may be formed of a separate piece and permanently joined to the solid body 130. Moreover, while the solid body 130 is described herein as being formed of a solid material or solid needle stock, in other examples the body 130 may be hollow or partially so.

As noted above, needle member(s) 120 may be formed in any size or configuration that is convenient. At smaller needle sizes, particularly with respect to smaller diameter sizes of the solid body 130, it may be relatively difficult to impart sufficient torque by hand upon the solid body 130 to adequately tighten the needle members 120/140 onto their respective needle connector 122/142, to the extent the needle connectors 122/142 and needle members 120/140 employ threaded connections. The same may be true for needle members 120/140 of relatively short overall lengths, which may also offer reduced surface area for a user to grip the needle members 120/140 by hand. In these cases of relatively small diameter or small length needle members, the needle grip aperture 132 may be employed to enhance grip of the needle member 120/140 and/or the solid body 130, as will be discussed further below.

Figure 4:
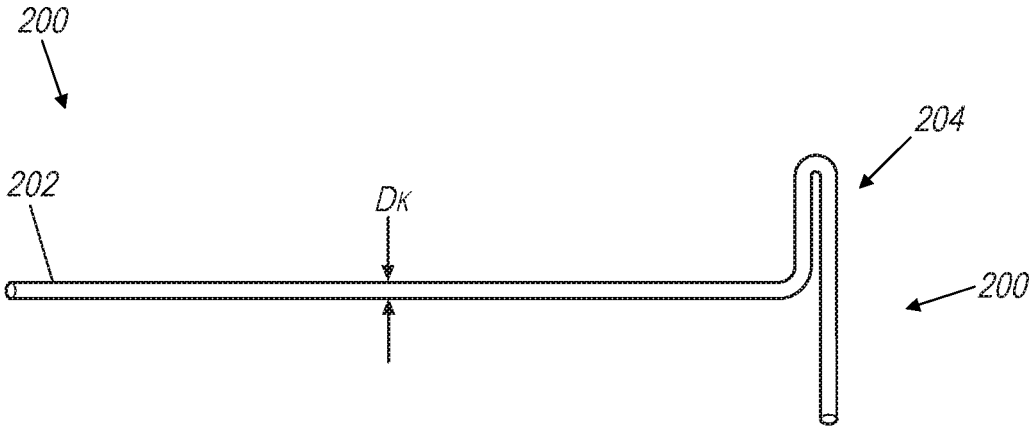
FIG. 4 is an upper perspective view of a key member for engaging in a grip aperture of a needle member and/or needle connector of FIGS. 1-3, according to one example approach.

In one example approach, a key member 200 may be employed, as illustrated in FIG. 4. The key member 200 may be a generally elongated body with a rounded end 202 that is appropriately sized to be received within the needle grip aperture 132 (and/or that of the needle connector 122, as will be described further below). The key member may have a rounded insert end 202 defining a diameter $D_K$, which is configured to be received within the needle grip aperture 132. For example, the diameter $D_K$ of the rounded end 202 may be sized to be received within the diameter $D_{A1}$ of the needle grip aperture 132, or slightly smaller. Opposite the insert end 202 may be a handle end 204. As illustrated in FIG. 4, the handle end 204 may be generally widened or enlarged, e.g., to facilitate gripping of the key member 200 by hand.

Upon insertion of the insert end 202 into the needle grip aperture 132, the key member 200 may generally rotate the needle member 120 about its longitudinal axis A-A. The relatively larger lever-arm provided by the key member 200, at least compared with the relatively small diameter of the solid body 130 of the needle member 120 (which, absent the needle grip aperture 132 and key member 200, would need to be gripped directly by hand) enhances the torque that may be imparted to the needle member 120. As will be described further below, the needle connector 122 may have an aperture configured to be gripped by a second key member 200, such that a relatively large torque may be imparted upon between the needle member 120 and needle connector 122.

More specifically, as shown in FIG. 3, needle connector 122/142 may have a connector grip aperture 188. Needle connector 122 may have an outer diameter $D_C$, which is substantially equal to that of the connector end diameter $D_E$ of the needle member 120. By matching the outer diameter of the needle connector 122 with the connector end diameter $D_E$ of the needle member 120, the outer surface of the knitting needle assembly 100 is generally smooth, facilitating sliding of yarn or other knitting mediums along the surface of the knitting needle assembly 100, including between the needle member 120 and needle connector 122. The connector grip aperture 188 may have a diameter $D_{A2}$. In an example, the diameter $D_{A2}$ of the connector grip aperture 188 is substantially equal to the diameter $D_{A1}$ of the needle grip aperture 132.

A second key member 200 may be inserted into the connector grip aperture 188 to enhance grip and torque applied to the needle connector 122, similar to the foregoing description of the use of a (first) key member 200 with the needle grip aperture 132 of the needle member 120. In this manner, two key members 200 may be used to provide a generally enhanced grip of the needle member 120 and needle connector 122 simultaneously, thereby increasing an amount of relative torque that may be applied by hand between the needle member 120 and needle connector 122.

Given the relatively increased magnitudes of torque that may be imparted between the needle members 120/140 and their respective needle connectors 122/142, the threaded connections between the needle members 120/140 and their respective needle connectors 122/142 may be configured to handle an increased maximum relative torque. The needle members 120 and/or 140 may thereby be tightened upon the cable 160 to a relatively larger torque limit than is typical for hand-tightened threaded members. Additionally, while smaller size needle members, e.g., below a 2.0 millimeter diameter, typically have relatively small torque limits, the use of the key member(s) 200 in conjunction with the needle grip aperture 132 and/or connector grip aperture 188 may facilitate a finer control of the application of torque by hand. Accordingly, the key members 200 may permit relatively quicker and/or more accurate application of torque to the needle members 120/140 by hand that is sufficient to create a stable connection for the needle members 120/140 to the cable 160 which resists loosening during use of the knitting needle 100.

As noted above, the needle member 120/140 may have any size or configuration that is convenient. Examples of typical size diameters of the needle members 120/140 are provided in Table 1:

TABLE 1

| US Size | $D_B$ (mm) |
|---|---|
| 000 | 1.50 |
| 00 | 1.75 |
| 0 | 2.00 |
| 1 | 2.25 |
| 1.5 | 2.50 |
| 2 | 2.75 |
| 2.5 | 3.00 |
| 3 | 3.25 |

As noted above in some examples, an interchangeable needle set may be provided, which comprises a plurality of needle members 120/140 of different lengths (L) or diameters ($D_B$), and a plurality of cables 160 of different lengths. In an example, the plurality of needle members 120/140 includes different overall lengths L. Similarly, the plurality of cables 160 may provide different cable lengths. Moreover, even with a relatively small number of different length needle members 120/140 and a relatively small number of different length cables 160, a wide variety of configurations of a circular knitting needle may be provided, as will be described further below.

Merely by way of example, an interchangeable knitting needle set may include four needle members 120/140, with two of the needle members 120/140 having a length L of approximately two inches (50.8 mm) and the other two needle members 120/140 having a length L of approximately three inches (76.2 mm). A plurality of different cables 160 may also be provided, each with different overall lengths. In an example where two different cable lengths are provided, the length of a first one of the cables 160 may be 5 inches (127.0 mm), with the length of a second cable 160 being 6 inches (152.4 mm). With this particular group of needle members 120/140 and cables 160, two needle members 120/140 and a cable 160 may be selectively assembled together to form a circular knitting needle 100 with the following configurations:

TABLE 2

| | 5" Cable | 6" Cable |
|---|---|---|
| 2" needle member + 2" needle member | 9" overall length | 10" overall length |
| 2" needle member + 3" needle member | 10" overall length | 11" overall length |
| 3" needle member + 3" needle member | 11" overall length | 12" overall length |

While the above example in Table 2 provides six different configurations for a circular knitting needle, it may be desirable to have an overall combined length of the needle members 120/140 that is no greater than that of the cable 160 in a knitting needle assembly, in order to provide sufficient flexibility and maneuverability of the needle members 120/140 when secured to the cable 160 for knitting. As such, if an eleven-inch length circular knitting needle is desired, it may be preferable to assemble one of the two-inch needle members 120/140 and one of the three-inch needle members 120/140 to the six-inch cable 160 (as opposed to assembling both three-inch needle members 120/140 to the five-inch cable 160).

With the four different needle members 120/140 in this example interchangeable knitting needle set having two different lengths that are different by an integer number of inches (in this case, by approximately one inch), and two different cable lengths, four different overall lengths of the circular knitting needle 100 may be created, as shown above in Table 2, thereby providing a substitute for four fixed circular knitting needles. The above example lengths may be particularly well-suited for sock knitting, which generally requires relatively short circular knitting needles, typically in the range of nine inches to twelve inches in overall length.

In other examples, an interchangeable knitting needle set may include additional needle member(s) 120/140 having different lengths L and/or diameters $D_B$, and/or additional cables 160. Merely as one example, by adding an additional cable 160 having a length of approximately eight inches (203.2 mm), additional circular knitting needles may be assembled by selecting two needle members 120/140 and assembling to the eight-inch cable 160. The addition of the eight-inch cable 160 results in additional lengths for a circular knitting needle of twelve inches (by assembling with two two-inch needle members 120/140), thirteen inches (by assembling with one two-inch needle member 120/140 and one three-inch needle member 120/140), and fourteen inches (by assembling with two three-inch needle members 120/140). In still other examples, sets may be provided with different diameter needle members 120/140. Accordingly, there is generally no limit on the variety of different configurations for a circular knitting needle that may be provided.

Moreover, where an interchangeable knitting needle set includes needle member(s) of a relatively small size diameter, particularly where the diameter of the needle member 120/140 is below 2.0 millimeters, key members 200 may be used to enhance the degree to which the needle members 120/130 and needle connectors 122/142 may be tightened by hand. Accordingly, a circular knitting needle 100 with a relatively secure connection between the needle members 120/140 and cable 160 may be provided in a number of configurations with different overall lengths, needle member lengths, or needle member diameters, while permitting relatively easy modifications by way of the interchangeable needle members 120/140.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said,"

etc. should be read to recite one or more of the indicated elements unless a claim recites an explicit limitation to the contrary.

What is claimed is:

1. An interchangeable knitting needle set, comprising:

at least four interchangeable needle members, each formed of a metallic material, the needle members each including:

a solid tip end;

a connecting end opposite the tip end, the connecting end having a threaded portion configured to be selectively secured to a flexible cable by rotating the needle member relative to the cable; and a solid body extending longitudinally from the solid tip end to the connecting end, the solid body defining a substantially round lateral cross-section, the solid body defining a needle grip aperture positioned adjacent the connecting end and extending laterally through the solid body, the needle grip aperture being fixed within the solid body relative to the threaded portion of the connecting end;

wherein one pair of the interchangeable needle members has a first needle length and a second pair of the interchangeable needle members has a second needle length greater than the first needle length;

at least two interchangeable cables for selectively securing any two of the interchangeable needle members together, wherein a first one of the cables has a first cable length and a second one of the cables has a second cable length greater than the first cable length, each of the cables having needle connectors at opposite ends thereof, at least a first one of the needle connectors of each of the cables defining a cable grip aperture and a connector thread configured to be secured to the threaded portion of one of the needle members; wherein the first cable length is greater than the first needle length; and a first key member and a second key member;

wherein the needle grip apertures of the needle members are each configured to receive the first key member, and the connector grip apertures of the cables are each configured to receive the second key member; and wherein the first and second key members are configured to apply a rotational torque to one of the needle members and one of the needle connectors to selectively rotate the one of the needle members about a longitudinal axis of the solid body relative to the one of the needle connectors.

2. The interchangeable knitting needle set of claim 1, wherein the solid body portion of each of the needle members defines a first cross-sectional diameter at the needle grip aperture, and the needle connectors each defining a second cross-sectional diameter at the connector grip aperture, wherein the first and second cross-sectional diameters are each smaller than 2.0 millimeters (mm).

3. The interchangeable knitting needle set of claim 1, wherein the metallic material is stainless steel.

4. An interchangeable knitting needle, comprising:

a first needle member formed of a metallic material, the first needle member including:

a solid tip end;

a connecting end opposite the tip end, the connecting end having a threaded portion configured to be selectively secured to a flexible cable by rotating the needle member relative to the cable; and a solid body extending longitudinally from the solid tip end to the connecting end, the solid body defining a substantially round lateral cross-section, the solid body defining a needle grip aperture positioned adjacent the connecting end and extending laterally through the solid body, the needle grip aperture being fixed within the solid body relative to the threaded portion of the connecting end;

wherein the needle grip aperture is configured to receive a key member configured to apply a rotational torque to the needle member, thereby rotating the needle member about a longitudinal axis of the solid body.

5. The interchangeable knitting needle of claim 4, further comprising the key member.

6. The interchangeable knitting needle of claim 4, wherein the metallic material is stainless steel.

7. The interchangeable knitting needle of claim 4, further comprising a cable having needle connectors at opposite ends thereof, at least a first one of the needle connectors defining a cable grip aperture and a connector thread configured to be secured to the threaded portion of the first needle member.

8. The interchangeable knitting needle of claim 7, further comprising a second needle member configured to be secured to a second one of the needle connectors.

9. The interchangeable knitting needle of claim 7, wherein the key member is a first key member, and the connector grip aperture is configured to receive a second key member, the first and second key members configured to apply a rotational torque to the needle member and needle connector to selectively rotate the needle member about a longitudinal axis of the solid body relative to the needle connector.

10. The interchangeable knitting needle of claim 8, wherein the interchangeable knitting needle is a circular knitting needle.

11. The interchangeable knitting needle of claim 4, wherein the solid body portion defines a cross-sectional diameter at the needle grip aperture smaller than 2.0 millimeters (mm).

12. The interchangeable knitting needle of claim 4, wherein the solid body portion defines a cross-sectional diameter that varies longitudinally along the solid body portion.

13. An interchangeable knitting needle set, comprising:

at least four interchangeable needle members as recited by claim 4, wherein one pair of the interchangeable needle members has a first needle length and a second pair of the interchangeable needle members has a second needle length greater than the first needle length; and at least two interchangeable cables for selectively securing any two of the interchangeable needle members together, wherein a first one of the cables has a first cable length and a second one of the cables has a second cable length greater than the first cable length, each of the cables having needle connectors at opposite ends thereof, at least a first one of the needle connectors of each of the cables defining a cable grip aperture and a connector thread configured to be secured to the threaded portion of one of the needle members.

14. The interchangeable knitting needle set of claim 13, wherein a difference between the first and second needle lengths is approximately one inch.

15. The interchangeable knitting needle set of claim 14, wherein the first needle length is approximately two inches, and the second needle length is approximately three inches.

16. The interchangeable knitting needle set of claim 13, wherein a difference between the first cable length and second cable length is approximately one inch.

17. The interchangeable knitting needle set of claim 13, wherein the first cable length is at least as great as the first two needle lengths combined.

18. The interchangeable knitting needle set of claim 13, wherein the key member is a first key member, and further comprising a second key member;

wherein the needle grip apertures of the needle members are each configured to receive the first key member, and the connector grip apertures of the cables are each configured to receive the second key member; and wherein the first and second key members are configured to apply a rotational torque to one of the needle members and one of the needle connectors to selectively rotate the one of the needle members about a longitudinal axis of the solid body relative to the one of the needle connectors.

19. The interchangeable knitting needle of claim 4, wherein the solid body portion defines a cross-sectional diameter at the needle grip aperture, and wherein the needle grip aperture defines a needle grip diameter that is no greater than half of the cross-sectional diameter.

20. The interchangeable knitting needle of claim 4, wherein the needle grip aperture defines a circular cross section in the solid body of the needle.

* * * * *